United States Patent [19]

Langley

[11] Patent Number: 4,843,861

[45] Date of Patent: Jul. 4, 1989

[54] BENDING MACHINES

[75] Inventor: Geoffrey T. Langley, Aldridge, England

[73] Assignee: Langbow Limited, West Midlands, England

[21] Appl. No.: 99,243

[22] Filed: Sep. 21, 1987

[30] Foreign Application Priority Data

Sep. 27, 1986 [GB] United Kingdom ..... 8623305

[51] Int. Cl.[4] ..... B21D 7/022

[52] U.S. Cl. ..... 72/306; 269/287; 269/229; 269/217; 279/34

[58] Field of Search ..... 72/306; 269/287, 229, 269/233, 235, 225, 217; 279/6, 9 R, 19.3, 33, 34, 1 TE, 81

[56] References Cited

U.S. PATENT DOCUMENTS

| | | | |
|---|---|---|---|
| 268,752 | 12/1882 | Trobach | 279/34 |
| 774,563 | 11/1904 | Clark | 269/225 |
| 2,600,707 | 6/1952 | Turnbaugh | 279/6 |
| 2,729,038 | 1/1956 | Hutchins | 279/33 |
| 2,883,198 | 4/1959 | Narumi | 279/33 |
| 2,952,467 | 9/1960 | Van Der Velden | 279/6 |
| 4,467,681 | 8/1984 | Oeming | 279/33 |
| 4,604,885 | 8/1986 | Lang | 72/306 |

FOREIGN PATENT DOCUMENTS

| | | | |
|---|---|---|---|
| 3301061 | 4/1984 | Fed. Rep. of Germany | 72/306 |
| 1268 | of 1912 | United Kingdom | 269/217 |

*Primary Examiner*—Daniel C. Crane

*Attorney, Agent, or Firm*—Neil F. Markva

[57] ABSTRACT

A bending machine comprises a plurality of bending units arranged to make bends in a common plane. The bending units are adjustably mounted to adjust the separation thereof in the common plane. Apparatus for holding and turning a workpiece about a predetermined axis is mounted between the bending units so that the predetermined axis is aligned or alignable with the common plane. The apparatus comprises a plurality of jaw members rotatable in unison about the predetermined axis. Each jaw member is axially open ended, has a central socket and a mouth extending from said socket to interrupt the periphery of the jaw member. The jaw members are interconnected and mounted to rotate in unison about the predetermined axis when at least one thereof is driven by a driving mechanism. A clamping jaw member is arcuately movable relative to the other or others between an open position, in which the mouths are aligned to admit a workpiece into the sockets, and a clamping position, in which the mouths are not aligned to trap the workpiece in the sockets. In the clamping position, the socket of the clamping jaw member is eccentric to the other or others of the sockets to exert a clamping force on the trapped workpiece.

24 Claims, 4 Drawing Sheets

BENDING MACHINES

FIELD OF THE INVENTION

This invention concerns apparatus for holding and turning elongate workpieces, and bending machines incorporating such apparatus.

BACKGROUND OF THE INVENTION

The applicants have produced a bending machine, known as the "Langbow Multiplane Tube Bending Machine Model TM32-5AX", which comprises two base units, each of which carries a bending unit, and, between the base units, an apparatus for holding and turning a tubular workpiece about a predetermined axis passing through the bending units.

Said apparatus comprises a clamping jaw member disposed between two abutment jaws members, which jaw members are co-axial with said predetermined axis. The periphery of each jaw member is near circular, is interrupted to provide a mouth and is provided with outwardly projecting gear teeth to serve as an interrupted ring gear. Within each jaw member the mouth leads to a part-circular socket, co-axial with said axis to receive a tubular workpiece of predetermined diameter. In the clamping jaw member there is a protruding wedge which extends inwards into a part of the socket adjacent to the mouth. The jaw members are mounted in a body and are engaged by respective toothed hydraulically driven racks actuable to move the jaw members through a restricted arc of a circle about said axis. The rack engaging the clamping jaw member can be moved, firstly, independently of the other racks to move the mouth of the clamping jaw member between an open position (in which the mouths are aligned) and a clamping position displaced from the open position so as thus to ram the wedge against the workpiece; and, secondly, in unison with the abutment jaw members.

This apparatus is intended to hold and turn the workpiece about said axis to permit the planes between the bends made by the bending units to be varied angularly, but several problems have arisen, from limitations inherent in this apparatus, including damage to the workpieces, imprecise angular adjustment or location of the workpieces and difficulties in loading the workpiece into the sockets in respect of some forms of tubing. Further problems have arisen because the apparatus cannot accommodate certain requirements for bending workpieces rapidly, for accepting workpieces of different diameters without changing the jaw members, for turning the workpieces through some ranges of angles and for accurate initial orientation of the workpieces.

The apparatus has, however, many advantages which make it particularly effective for use in mass-producing relatively complex shapes from constant-single-diameter workpieces provided that the angles between the planes of adjacent bends lie within certain limited ranges and need to be only approximately accurate to within a few degrees, e.g. for producing wheelbarrow chassis.

An object of the present invention is to enable said problems to be overcome or reduced, and to improve said advantages.

SUMMARY OF THE INVENTION

According to the present invention there is generally provided apparatus for holding and turning an elongate workpiece, comprising a plurality of jaw members, movable in unison about a predetermined axis; wherein each jaw member is axially open ended, has a central socket and a mouth extending from said socket to interrupt the periphery of the jaw member. The jaw members are interconnected and mounted to rotate in unison about the predetermined axis when at least one thereof is driven by driving means. A clamping jaw member is arcuately movable relative to the other or others between an open position, in which the jaw member mouths are aligned to admit a workpiece into the sockets, and a clamping position, in which said mouths are not aligned to trap the workpiece in the sockets. In the clamping position, the socket of the clamping jaw member is eccentric to the other or others of the sockets to exert a clamping force on the trapped workpiece.

According to the present invention there is provided apparatus for holding and turning an elongate workpiece, comprising a plurality of jaw members movable or rotatable in unison about a predetermined axis. Each jaw member is axially open ended, has a central socket and a mouth extending from said socket to interrupt the periphery of the jaw member.

An abutment one of said jaw members is peripherally toothed and is co-axial and rotatable about with said predetermined axis. A clamping one of said jaw members is connected to said abutment jaw member for arcuate movement about a clamping axis offset from and parallel with said predetermined axis. Drive means cause said clamping jaw member to turn about said clamping axis relative to the abutment jaw member.

Preferably, said axes are parallel in a predetermined relationship; pass substantially centrally through the sockets; and are separated by a distance less than one millimeter.

According to the present invention there is provided apparatus for holding and turning an elongate workpiece, comprising a plurality of jaw members rotatable in unison about a predetermined axis. Each jaw member is axially open ended, has a central socket and a mouth extending from said socket to interrupt the periphery of the jaw member.

An abutment one of said jaw members is peripherally toothed, is co-axial with said predetermined axis, and is engaged by driving means so as to be rotatable about said axis.

The driving means comprises primary and secondary driving gears which mesh with the peripheral teeth of the abutment jaw member at engagement locations which are spaced peripherally of the abutment jaw member by an arc greater than the arcuate extent of the mouth.

A clamping one of said jaw members is rotatable about said predetermined axis by said abutment jaw member.

In a specific embodiment, the jaw members comprise one clamping jaw member disposed between and carried by two of the abutment jaw members by offset bearing means. The jaw members are peripherally assembled together to form a clamping unit mounted in bearings co-axial with said predetermined axis with the bearings being part circular and interrupted by fixed mouths.

According to the present invention there is provided apparatus for holding and turning an elongate workpiece. The apparatus comprises a plurality of jaw members movable in unison about a predetermined axis. Each jaw member is axially open ended, has a central socket and a mouth extending from said socket to interrupt the periphery of the jaw member.

Each socket includes a replaceable part-cylindrical insert to engage the workpieces. The insert includes abutment means which extends axially of the socket, prevents rotation of the insert in the socket, and permits the insert to slide axially into the socket from one axially open end of the socket. Said one open end may be partially restricted by removable retaining means to retain the insert in the socket.

At least one of the inserts is preferably of a material which is harder and more rigid than the material from which another of the inserts is made.

The apparatus preferably includes brake means to halt movement of the clamping jaw member, which brake means may serve in combination with the drive means as said means for causing relative rotation.

A stop may be provided to limit the arcuate extent of said relative rotation.

A sensor is preferably provided to determine when the jaw members or at least one thereof is or are in a predetermined angular position.

The invention includes a bending machine comprising a plurality of bending units arranged to make bends in a common plane. The bending units being adjustably mounted to adjust the separation thereof. Apparatus of the invention is mounted between bending units so that said predetermined axis is aligned or alignable with said common plane.

The mounting of the apparatus preferably permits said predetermined axis to be moved horizontally and vertically relative to the bending units.

BRIEF DESCRIPTION OF THE DRAWINGS

Other objects of this invention will appear in the following description and appended claims, reference being made to the accompanying drawings forming a part of the specification wherein like reference characters designate corresponding parts in the several views.

DETAILED DESCRIPTION

Figure 1:
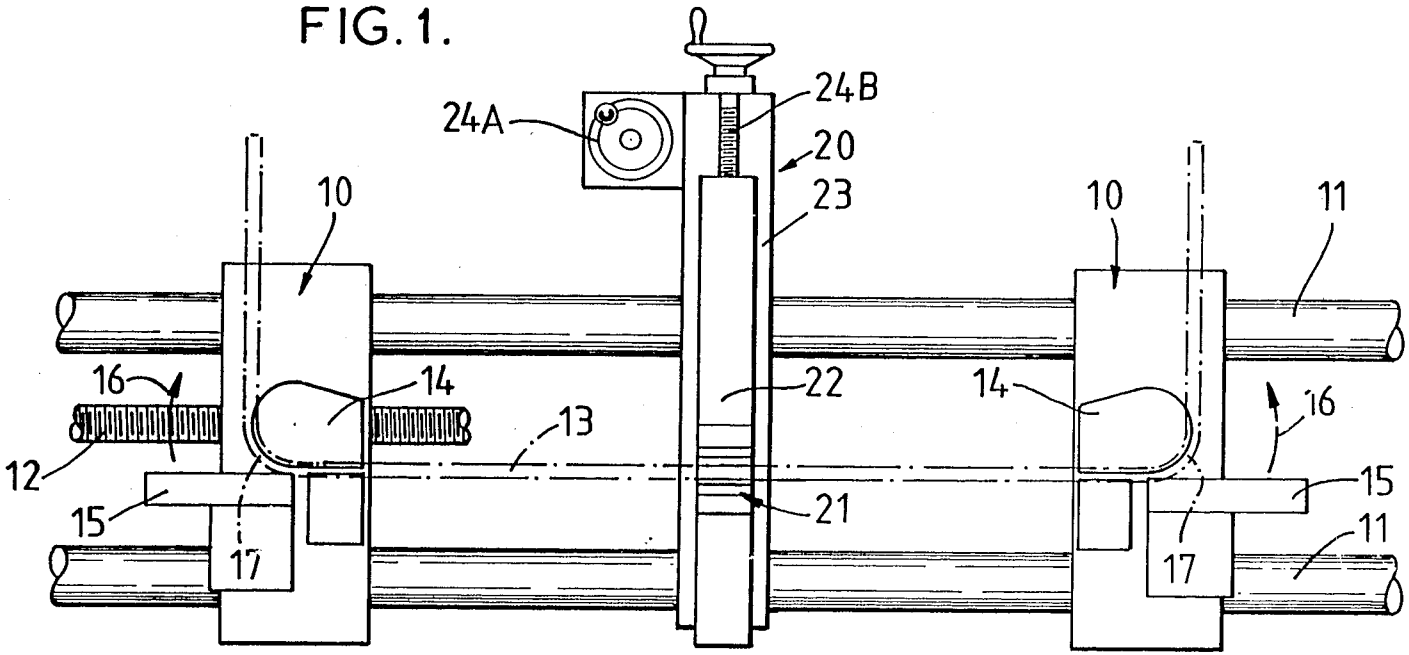
FIG. 1 is a fragmentary front elevational view showing parts of a bending machine and apparatus of the invention.

The bending machine (FIG. 1) comprises two bending units 10 carried by slides 11 and movable by respective motor driven screws 12 (only one of which is represented) to control the movement and positions of the bending units along the slides 11; together with apparatus, generally designated 20, for holding and rotating a workpiece, e.g. a tube 13 shown in broken lines. The apparatus 20 comprises a clamping unit 21 mounted rotatably on a body 22 which is in turn mounted on a mounting 23 provided with adjustment means 24B to move the body 22 and clamping unit 21 vertically relative to bending units 10. Further adjustment means 24A move body 22 and clamping unit 21 forwardly and backwardly relative to bending units 10. Thus, the axis of the unbent tube 13 held in clamping unit 21 can be brought into and adjusted for height in the plane in which bending units 10 make bends so as to be accurately aligned with the bending tools 14 and 15 provided for bending units 10. Bending tools 15 are movable by bending units 10 as indicated by the arrows 16 to make bends 17 in the nominally vertical bending plane.

Clamping unit 21 is rotatable about a predetermined axis 18 (FIG. 4) and holds the tube 13 co-axial with said axis, to enable the tube to be rotated so that the planes of consecutive bends may be mutually inclined at any desired angle.

Clamping unit 21 comprises three jaw members, namely two abutment jaw members 24 and a clamping jaw member 25 therebetween assembled together to form a replaceable assembly. Each jaw member 24 or 25 is substantially circular, and has a respective toothed periphery 26A or 26B interrupted by a mouth 27 which leads to a central socket 28. Mouth 27 and socket 28 are open at the axial ends or sides of the jaw members 24 and 25 so that when the mouths 27 are aligned, a tube can be inserted therethrough into sockets 28 to extend axially centrally through clamping unit 21.

Figure 5:
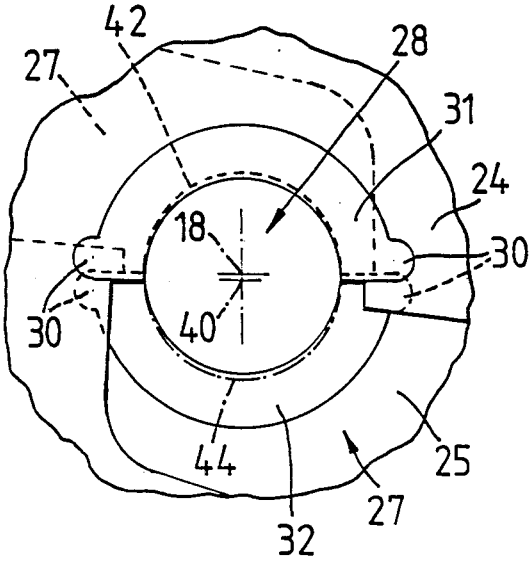
FIG. 5 shows part of the clamping in side elevation.
Figure 3:
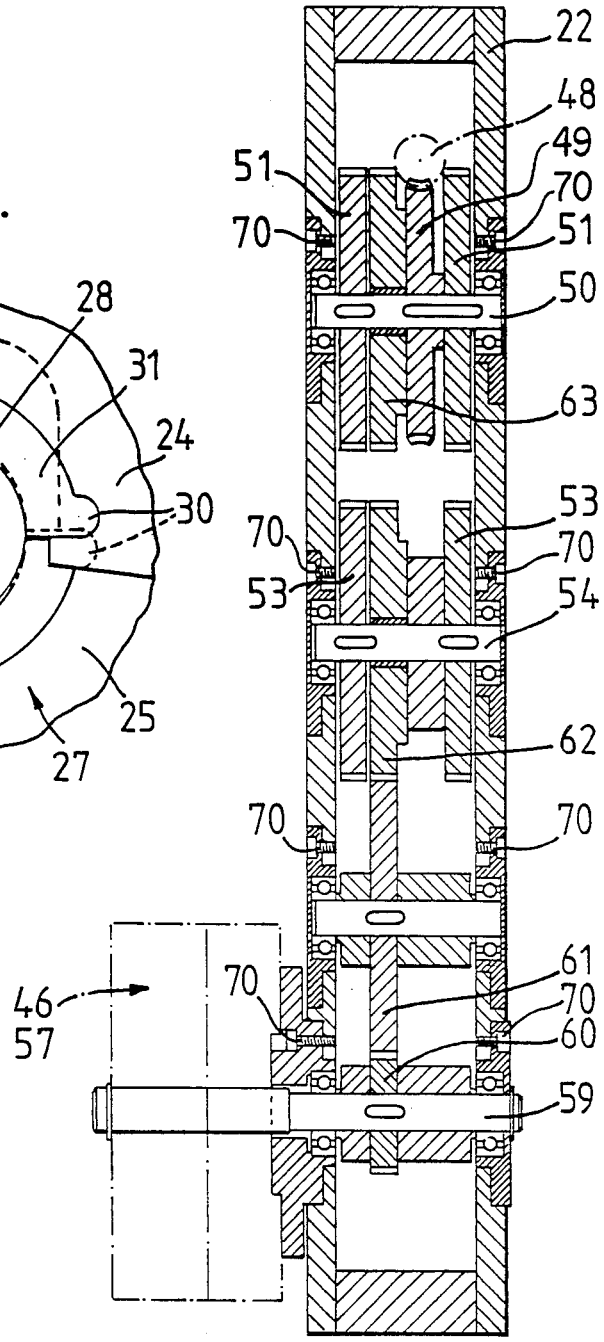
FIG. 3 is a cross-sectional view of the apparatus.
Figure 6:
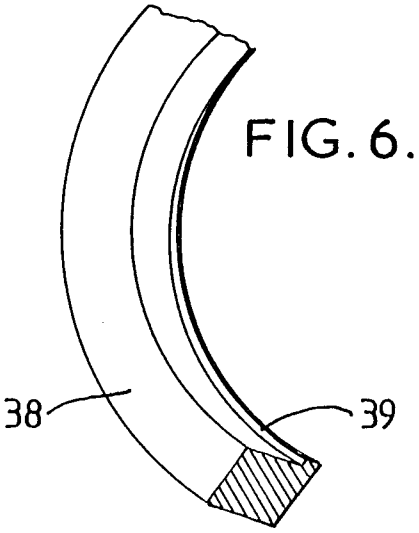
FIG. 6 shows part of an eccentric bearing member incorporated in the clamping unit.
Figure 4:
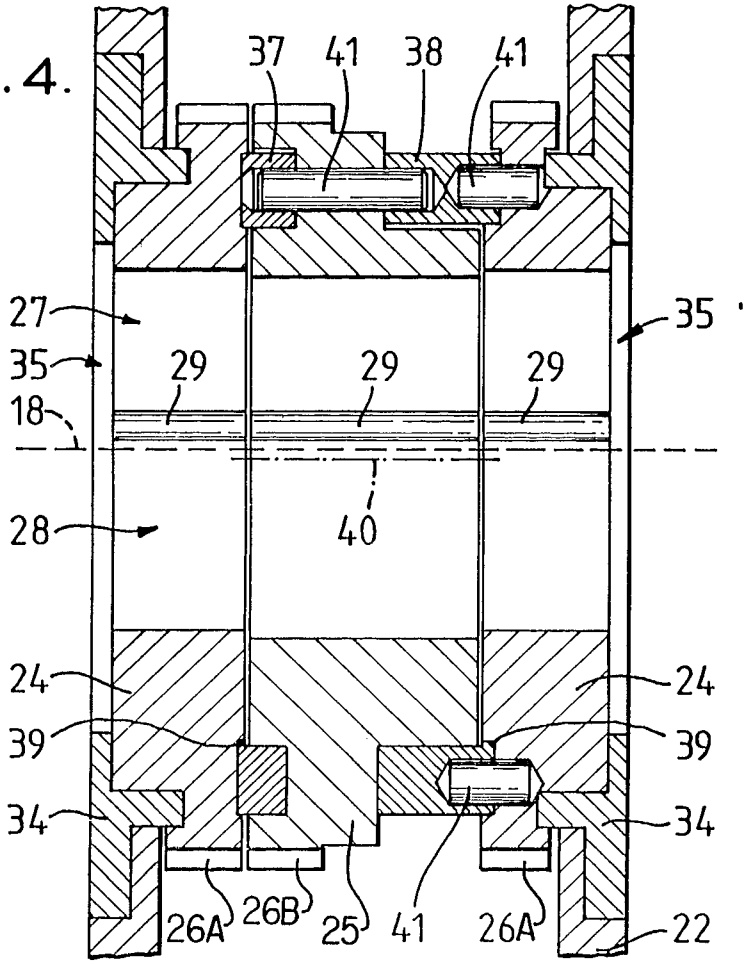
FIG. 4 is an enlarged cross-sectional diagram of a clamping unit incorporated in the apparatus.

The internal surface of each jaw 24 and 25 includes abutment means comprising two axially extending near-diametrically opposed recesses 29, at the junction of mouth 27 and socket 28, to receive protuberances 30 at each end of an almost semi-circular insert or liner 31 or 32 (not shown in FIG. 4 but see FIG. 5). Recesses 29 are longitudinally aligned when mouths 27 of jaw members 24 and 25 are aligned to allow liners 31 and 32 to slide into or out of clamping unit 21 from either end. The radial thickness of liners 31 and 32 is selected so that the internal radius of each liner is commensurate with the tube radius of the tube being bent.

The outside axial ends of jaw members 24 are engaged and supported by main bearing members 34 supported on a forwardly extending part of the body 22, so that the entire clamping unit 21 is bodily rotatable about the axis 18, jaw members 24 and 34 being concentric with said axis. Each bearing member 34 has a fixed mouth 35 leading to a central recess which is partially closed by a retaining means comprising detachable end plates 36 (FIG. 2 only) releasably secured to the jaw members 24 to retain the liners 31 and 32 in clamping unit 21.

The clamping jaw member 25 has an axis 40, referred to as "the clamping axis". The inside ends of jaws members 24 and both ends of the clamping jaw member 25 are circularly recessed or slotted to engage offset bearing means comprising stepped part-circular friction bearing members 37 and 38 each of which has a crescent-shaped land 39 which is eccentric to the remainder of and fits co-axially into the respective jaw member 24. Said remainder is co-axial with the clamping axis 40 of clamping jaw member 25 so that member 25 is arcuately movable, relative to jaw members 24, about said clamping axis 40. The members 37 and 38 serve as frictional engagement means between jaw members 24 and 25 to entrain the member 25 to move with jaw members 24 when the latter are rotated without a workpiece in clamping unit 21.

Jaw members 24 and 25 are slotted and recessed to receive, fixedly or slidably, metal pins 41 which serve as stops to prevent unwanted relative movements between the members 24, 25, 37 and 38 and to restrict the arcuate movement of clamping jaw member 25 relative to jaw members 24 to a maximum arc, e.g. to 180° from an open position, in which all mouths 27 are aligned (FIGS. 1, 2 and 4) to a clamping position, as shown in FIG. 5.

Clamping axis 40 is offset from the axis 18 in a direction toward sockets 28 in jaw members 24 (downwards in FIGS. 4 and 5) by an amount which is predetermined by the radial maxima of the lands 39 to suit the nature of liners 31, 32 and the workpieces. Such offset will commonly be about 0.1 mm, but could well be varied within a wide range, e.g. from about 0.05 to 1 mm depending upon the clamping compression to be produced when a workpiece, of overall radius equal to the internal radius of liners 31, 32 is held in clamping unit 21. In the clamping position, liners 31 are on a circle continued in broken lines 42 in FIG. 5, whereas liner 32 is eccentric to the circle as indicated in FIG. 5 which eccentricity is equal to the maximum amount of clamping compression. The liners 31 are preferably of steel or a like hard material, wherein liner 32 is preferably of a plastics material, such as nylon, which:

(a) is more compressible than steel, (b) provides a smooth non-abrasive surface, and (c) is hard wearing and resistant to tearing, cracking and splintering.

The internal shape of liners 31 may be non-circular, e.g. to conform to part of a non-circular workpiece to accept and support the workpiece so that it, firstly, lies radially inwards beyond the inner surface of liner 32 in said open position, which surface has the position shown in chain-broken lines 44, and, secondly, extends to or to close to said continuation 42 indicated in broken lines for clamping by the liner 32 in the clamping position indicated in FIG. 5.

The body 22 carries drive means 45 and brake means 46 which together constitute means for causing said relative arcuate movement between jaw members 24 and 25. The drive means 45 includes an electrically actuated stepping motor 47 to drive abutment jaw members 24 via a train comprising an input shaft 48 with a worm gear 48A, an input spur gear 49 keyed to a primary shaft 50, paired primary driving gears 51 keyed to shaft 50, paired idler gears 52 and paired secondary driving gears 53 keyed to a secondary shaft 54. The primary driving gears 51 engage the toothed periphery 26A at a primary location 55; and the secondary driving gears 53 engage the teeth 26A at a secondary location 56 which is separated angularly about said axis 18 by an amount which is greater than the angle through which the toothed periphery 26 is interrupted by mouth 29 of each jaw member 24, 25. The shafts 48, 50 and 54 are adjustably mounted to permit backlash in said train to be removed.

The brake means 46 comprises an electrically actuated brake 57 to halt clamping jaw member 25 via a free running train comprising a brake shaft 59 having a keyed gear 60, an idler gear 61, a secondary brake gear 62 free running on shaft 54, an idler gear free running on an adjustable shaft (not shown) which carries gears 52, and a primary brake gear 63 free running on shaft 50. The brake gears 62 and 63 engage the toothed periphery 26B of the jaw member 25 at said locations 55 and 56. The body 22 also carries a sensor 64 to determine when mouths 27 are aligned with an opening 65 in the forwardly extending part of body 22 and fixed mouths 35 in bearings 34.

In use, when brake 46 is disengaged, drive is transferred from motor 47 via the drive means 45 to the jaw members 24, and from the jaw members 24 to the clamping jaw member 25 to rotate the jaw members 24 and 25 in unison so that all the torque necessary to rotate the workpiece is transmitted by the abutment jaw members 24 to the workpiece, irrespective of the angular position of the abutment jaw members 24, thus preventing accidental opening of the clamping 21 unit. During such movement, the free running train is driven by the clamping jaw member 25 but the train is sufficiently free running not to exert a torque load upon the clamping jaw member 25 which could alter the angular relationship between the jaw members 24 and 25.

The bending machine is provided with an electronic control unit capable of being programmed to control a sequence of bends in a bending cycle which includes:

(a) bringing the jaw members to, or ensuring that the jaw members are in, the open position in alignment with the opening 65 for insertion of a workpiece into the sockets, so as to be aligned with the tools 14 and 15;

(b) rotating the abutment jaw members 24 while holding the clamping jaw member 25 to clamp the workpiece in the sockets, and releasing the brake;

(c) moving the bend units 10 longitudinally of the slides to predetermined positions;

(d) actuating the bend units to make bends in said plane, and moving said units to the positions for the next bends;

(e) rotating the workpiece, by driving the members 24, through a predetermined angle if the next bend or bends is or are to be made in a different plane, during which rotation the brake is not engaged so that the jaw members rotate in unison;

(f) repeating steps (d) (e) and (f) as needed to complete bending of the workpiece; and (g) actuating the clamping unit 21 to permit the bent workpiece to be removed.

The step (g) can be performed simply by engaging the brake, rotating the jaw members 24 to the open position, disengaging the brake and turning the jaw members 24 and 25 in unison into alignment with the opening 65. However, it may be beneficial to first bring the workpiece into a safe, convenient or otherwise desirable final angular position, e.g. to be taken up by tube handling apparatus for transfer to a subsequent workstation, prior to clamping being released by relative arcuate movement between the jaw members 24 and 25.

Figure 2:
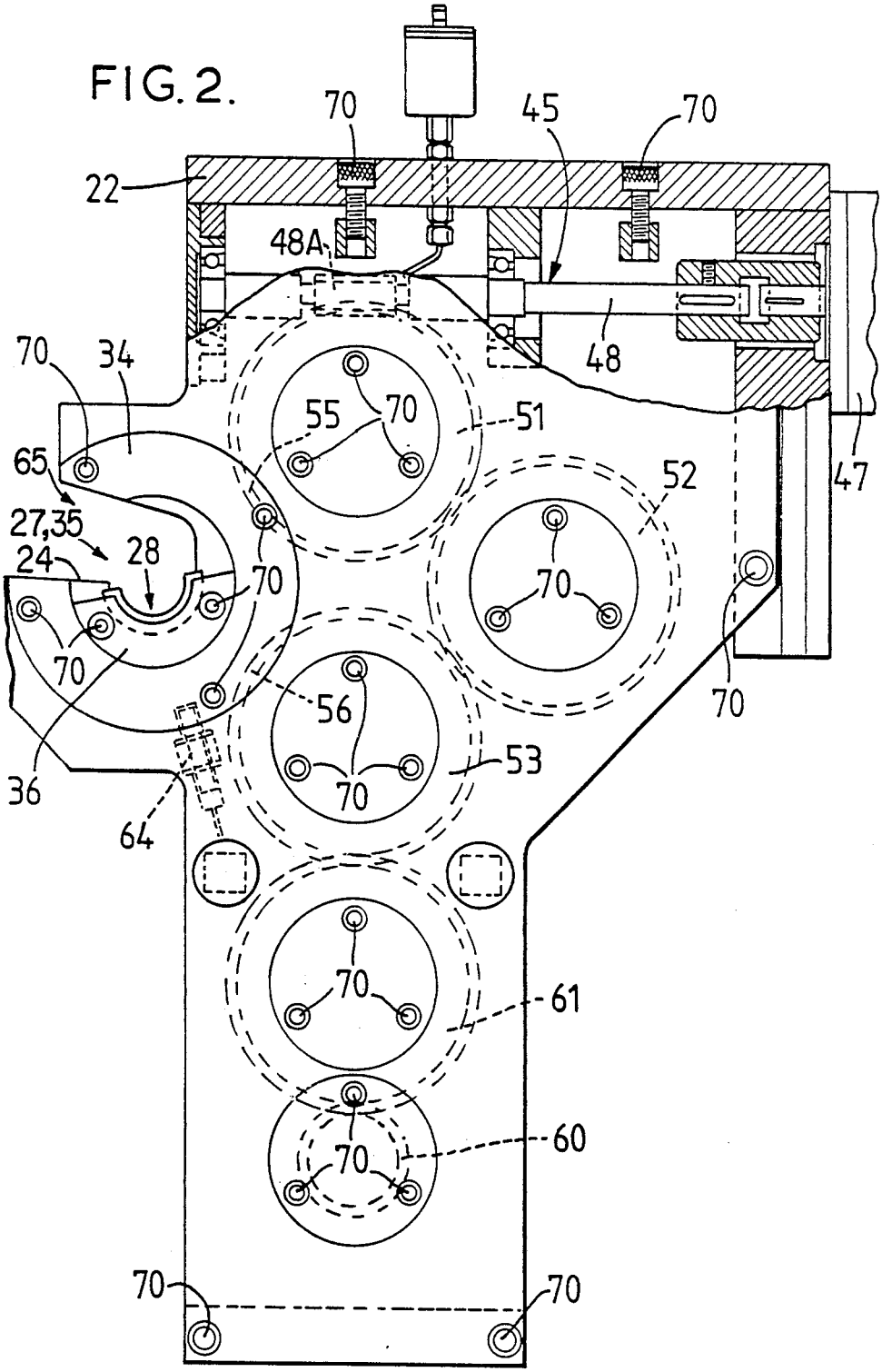
FIG. 2 is a partial sectional, side elevational view of apparatus of the invention.

Threaded fasteners are indicated by reference numeral 70 in FIG. 2.

Clamping invention is not confined to details of the foregoing example, and many variations are possible within the scope of the invention. For example, the periphery of the jaw member 25 may be plain cylindrical and the brake may comprise a brake shoe actuable to engage frictionally upon said periphery, to obviate the braking train.

While the bending machine has been shown and described in detail, it is obvious that this invention is not to be considered as limited to the exact form disclosed, and that changes in detail and construction may be made therein within the scope of the invention without departing from the spirt thereof.

The relative hardness of the liners may be reversed so that the liner 32 is harder than the liners 31. Instead of being of different materials, the liners may be of the same material, and may have different internal surface finishes.

The unit 21 may be hydraulically instead of electrically operated, and may be releasably attached to the mounting 23.

I claim:

1. Apparatus for holding an elongate workpiece, comprising:

(a) a plurality of jaw members movable in unison about a first predetermined axis;

(b) each jaw member is open ended, has a central socket, a periphery and a mouth extending from said socket to interrupt the periphery of the jaw member, said mouth being effective to allow a workpiece to pass therethrough to each said socket;

(c) said jaw member including an abutment jaw member and a clamping jaw member; said abutment jaw member including means for rotating said abutment jaw member about a rotational axis which is co-axial with said first predetermined axis;

(d) said clamping jaw member being connected to said abutment jaw member for arcuate movement about a clamping axis offset from and parallel with said first predetermined axis; and (e) drive means for causing said clamping jaw member to turn about said clamping axis relative to the abutment jaw member so that when the clamping jaw member and abutment jaw member are in an offset position with respect to each other, said jaw members are effective to clamp a workpiece within said central sockets.

2. Apparatus as claimed in claim 1, wherein said axes are fixed, parallel, pass substantially centrally through the sockets and are separated by a distance of less than one millimeter.

3. Apparatus as claimed in claim 1, wherein said jaw members are connected by frictional entrainment means, and said abutment jaw member rotating means is driven by driving means.

4. Apparatus as claimed in claim 1, wherein each socket includes a replaceable part-cylindrical insert to engage the workpieces, said insert having abutment means to prevent rotation of the insert relative to the socket and permits the insert to be slid, longitudinally of the axis, into the jaw member.

5. Apparatus as claimed in claim 4, wherein at least one of the inserts is of a material which is harder and more rigid than the material from which another of the inserts is made.

6. Apparatus as claimed in claim 1, wherein brake means halt movement of the clamping jaw member and serve in combination with the drive means for causing said relative rotation.

7. Apparatus as claimed in claim 6, wherein a stop is provided to limit the arcuate extent of said relative rotation between the jaw members.

8. Apparatus for holding an elongate workpiece, comprising:

(a) a plurality of jaw members movable in unison about a predetermined axis;

(b) each jaw member is axially open ended, has a central socket, a periphery and a mouth extending from said socket to interrupt the periphery of the jaw member, said mouth being effective to allow a workpiece to pass therethrough to each said socket;

(c) said jaw members include an abutment jaw member and a clamping jaw member;

(d) the abutment jaw member is rotatable about an axis which is co-axial with said predetermined axis, and includes a peripherally toothed portion engaged by driving means;

(e) said driving means comprises primary and secondary driving gears which mesh with the peripheral teeth of the abutment jaw member at engagement locations which are spaced peripherally of the abutment jaw member by an arc greater than the arcuate extent of the mouth along the periphery; and (f) the clamping jaw member is rotatable about said predetermined axis by said abutment jaw member.

9. Apparatus as claimed in claim 8, wherein said jaw members comprise one clamping jaw member disposed between and carried by two of the abutment jaw members by offset bearing means, said jaw members are peripherally assembled together to form a clamping unit mounted in bearings co-axial with said predetermined axis; and said bearings having peripherally open fixed mouths.

10. Apparatus as claimed in claim 9, wherein a sensor determines when the mouths of the jaw members are aligned with said fixed mouths.

11. Apparatus as claimed in claim 1 wherein the rotating means for the abutment jaw member includes a peripherally toothed portion engaged by driving means;

said driving means comprises primary and secondary driving gears which mesh with the peripheral teeth of the peripherally toothed portion at engagement locations which are spaced peripherally of the abutment jaw member by an arc greater than the arcuate extent of the mouth;

the clamping jaw member is rotatable about said predetermined axis by said abutment jaw member.

12. Apparatus as claimed in claim 1, wherein said jaw members comprise one clamping member disposed between and carried by two of abutment jaw members by offset bearing means, and said jaw members are peripherally assembled together to form a clamping unit mounted in bearings co-axial with said predetermined axis, said bearings being part circular and interrupted by fixed mouths.

13. Apparatus as claimed in claim 12, wherein a sensor determines when the mouths of the jaw members are aligned with said fixed mouths.

14. Apparatus as claimed in claim 9, wherein each socket includes a replaceable part-cylindrical insert to engage the workpiece, said insert having abutment means to prevent rotation of the insert relative to the socket;

said abutment means permits the insert to be slid, longitudinally of the axis, into the jaw member.

15. Apparatus as claimed in claim 8, wherein brake means halt movement of the clamping jaw member by the abutment jaw member.

16. Apparatus as claimed in claim 15, wherein a stop is provided to limit the arcuate extent of said relative rotation between the jaw members.

17. A bending machine comprising:

(a) a plurality of bending units arranged to make bends in a common plane, (b) the bending units being mounted so that the separation thereof is adjustable, and (c) apparatus for holding a workpiece along a predetermined axis mounted between bending units so that said predetermined axis is alignable with said common plane;

(d) said apparatus comprising a plurality of jaw members movable in unison about said predetermined axis;

(e) each jaw member is axially open ended, has a central socket, a periphery and a mouth extending from said socket to interrupt the periphery of the jaw member, said mouth being effective to allow a workpiece to pass therethrough to each said socket;

(f) said jaw members are interconnected and mounted to rotate in unison about the predetermined axis when at least one of the jaw members is driven by driving means;

(g) one of the jaw members is arcuately movable relative to another of the jaw members between an open position, in which the mouths are aligned to admit a workpiece into the sockets, and a clamping position in which said mouths are not aligned to trap the workpiece in the sockets; and (h) in said clamping position the socket of said one jaw member is eccentric to another of the sockets to exert a clamping force on the trapped workpiece.

18. A bending machine as claimed in claim 17, wherein the mounting of the apparatus permits said predetermined axis to be moved horizontally and vertically relatively to the bending units.

19. A bending machine as claimed in claim 17, wherein said jaw members include an abutment jaw member and a clamping jaw member, said abutment jaw member having a peripherally toothed portion and is co-axial with said predetermined axis, said clamping jaw member is connected to said abutment jaw member for arcuate movement about a clamping axis offset from and parallel with said predetermined axis, and drive means cause said clamping jaw member to turn about said clamping axis relative to the abutment jaw member.

20. A bending machine as claimed in claim 19, wherein the abutment jaw member is engaged by driving means, said drive means comprises primary and secondary driving gears which mesh with the peripheral teeth of the toothed portion at engagement locations which are spaced peripherally of the abutment jaw member by an arc greater than the arcuate extent of the mouth, the clamping jaw member is rotatable about said predetermined axis by said abutment jaw member.

21. Apparatus for holding and turning an elongate workpiece comprising:

(a) holding means including a plurality of jaw members rotatable in unison about a first predetermined axis therein;

(b) turning means in driving engagement with said holding means to rotate said jaw members in unison;

(c) each jaw member is open ended, has a central socket, a periphery and a mouth extending from said socket to interrupt the periphery of the jaw members, said mouth being effective to allow a workpiece to pass therethrough to each said socket;

(d) a first jaw member is rotatable about an axis which is co-axial with said first predetermined axis and including means for rotating said first jaw member;

(e) a second jaw member is movably connected to one side of said first jaw member by frictional entrainment means for arcuate movement about a clamping axis offset from and parallel with said first predetermined axis; and (f) drive means cause the second jaw member to turn about said clamping axis relative to the first jaw member between an open position and a clamping position;

(g) said mouths are aligned in said open position and said mouths are not aligned and mutually axially offset to clamp a workpiece in said clamping position therein.

22. Apparatus as claimed in claim 21, wherein said means for rotating said first jaw member comprises a peripherally toothed portion.

23. Apparatus for holding and turning an elongate workpiece comprising:

(a) holding means comprising a plurality of jaw members rotatable in unison about a predetermined axis;

(b) each jaw member is axially open ended, has a central socket, a periphery and a mouth extending from said socket to interrupt the periphery of the jaw member through a predetermined arcuate extent, said mouth being effective to allow a workpiece to pass therethrough to each said socket;

(c) a first jaw member is rotatable about an axis which is co-axial with said predetermined axis and has a peripherally toothed portion engaged by driving means for rotating said holding means to turn a workpiece;

(d) said driving means comprises primary and secondary driving gears which mesh with the peripheral teeth of the first jaw member at engagement locations which are spaced peripherally of the first jaw member by an arc greater than the predetermined arcuate extent of the mouth;

(e) a second jaw member is rotatable about said predetermined axis by said first jaw member; and (f) one of said jaw members is arcuately movable relative to another of said jaw members between an open position, in which the mouths are aligned to admit a workpiece into the sockets, and a clamping position, in which said mouths are not aligned to trap the workpiece in the sockets.

24. A bending machine comprising:

(a) a plurality of bending units arranged to make bends in a common plane;

(b) the bending units being adjustably mounted on a frame to adjust the separation thereof in said common plane;

(c) apparatus for holding and turning a workpiece about a predetermined axis mounted between said bending units so that said predetermined axis is alignable with said common plane;

(d) said apparatus comprising a plurality of jaw members rotatable in unison about said predetermined axis;

(e) each jaw member is axially open ended, has a central socket, a periphery and a mouth extending from said socket to interrupt the periphery of the jaw member, said mouth being effective to allow a workpiece to pass therethrough to each said socket;

(f) said jaw members are interconnected and mounted to rotate in unison about the predetermined axis when at least one of the jaw members is driven by driving means;

(g) one of the jaw members is a clamping jaw member and is arcuately movable relative to another of the jaw members between an open position, in which the mouths are aligned to admit a workpiece into the sockets, and a clamping position in which said mouths are not aligned to trap the workpiece in the sockets; and (h) in said clamping position the socket of said clamping jaw member is eccentric to the other or others of the sockets to exert a clamping force on the trapped workpiece.

* * * * *